US006321705B1

(12) United States Patent
Fernandez et al.

(10) Patent No.: US 6,321,705 B1
(45) Date of Patent: Nov. 27, 2001

(54) ROLLER FINGER FOLLOWER FOR VALVE DEACTIVATION

(75) Inventors: Hermes A. Fernandez, Rochester; Jongmin Lee, Pittsford; Mark James Spath, Spencerport, all of NY (US); Nick John Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/557,732

(22) Filed: Apr. 26, 2000

Related U.S. Application Data

(60) Provisional application No. 60/159,698, filed on Oct. 15, 1999.

(51) Int. Cl.[7] ..... F01L 13/00; F02D 13/06

(52) U.S. Cl. ..... 123/90.16; 123/90.42; 123/198 F

(58) Field of Search ..... 123/90.15, 90.16, 123/90.39, 90.41, 90.42, 90.43, 90.44, 198 F

(56) References Cited

U.S. PATENT DOCUMENTS

| | | | | |
|---|---|---|---|---|
| 4,537,165 | | 8/1985 | Honda et al. | 123/90.16 |
| 4,576,128 | | 3/1986 | Nagahiro | 123/198 F |
| 4,768,467 | * | 9/1988 | Yamada et al. | 123/90.16 |
| 5,361,733 | | 11/1994 | Spath et al. | 123/90.16 |
| 5,398,648 | | 3/1995 | Spath et al. | 123/90.16 |
| 5,431,133 | | 7/1995 | Spath et al. | 123/90.16 |
| 5,544,626 | * | 8/1996 | Diggs et al. | 123/90.16 |
| 5,606,939 | | 3/1997 | Spath | 123/90.5 |
| 5,653,198 | | 8/1997 | Diggs | 123/90.16 |
| 5,655,488 | * | 8/1997 | Hampton et al. | 123/90.16 |
| 6,058,895 | * | 5/2000 | Hermsen | 123/90.16 |
| 6,186,101 | * | 2/2001 | Kreuter | 123/90.15 |

* cited by examiner

*Primary Examiner*—Weilun Lo
(74) *Attorney, Agent, or Firm*—John A. Vanophem

(57) ABSTRACT

A deactivation roller finger follower for use with an internal combustion engine includes an elongate body. The body has a valve pallet end and a socket. The pallet end is configured for engaging a valve stem of the internal combustion engine. The socket is configured for engaging a hydraulic lash adjuster of the internal combustion engine. The body defines a roller aperture. A roller is disposed within the roller aperture. The roller is configured for engaging a cam lobe of the internal combustion engine. The roller defines a shaft orifice therethrough. An elongate shaft extends transversely through the shaft orifice. In a default operating position, the shaft is coupled to the body to thereby transfer rotary motion of the cam to pivotal movement of the body about the hydraulic lash adjuster. The shaft is selectively decoupled from the body such that the rotary motion of the cam is not transferred to pivotal movement of the body.

19 Claims, 3 Drawing Sheets

ROLLER FINGER FOLLOWER FOR VALVE DEACTIVATION

CROSS-REFERENCE TO RELATED APPLICATIONS

This application claims the benefit of U.S. Provisional Application Ser. No. 60/159,698, filed Oct. 15, 1999.

FIELD OF THE INVENTION

The present invention relates to a device which accomplishes cylinder deactivation and/or individual valve deactivation in internal combustion engines. More particularly, the present invention relates to a finger follower rocker arm device which accomplishes cylinder deactivation and/or individual valve deactivation in internal combustion engines having valve trains which use hydraulic lash adjusters.

BACKGROUND OF THE INVENTION

Automobile emissions are said to be the single greatest source of pollution in several cities across the country. Automobiles emit hydrocarbons, nitrogen oxides, carbon monoxide and carbon dioxide as a result of the combustion process. The Clean Air Act of 1970 and the 1990 Clean Air Act set national goals of clean and healthy air for all and established responsibilities for industry to reduce emissions from vehicles and other pollution sources. Standards set by the 1990 law limit automobile emissions to 0.25 grams per mile (gpm) non-methane hydrocarbons and 0.4 gpm nitrogen oxides. The standards are predicted to be further reduced by half in the year 2004. It is expected that automobiles will continue to be powered by internal combustion engines for decades to come. As the world population continues to grow, and standards of living continue to rise, there will be an even greater demand for automobiles. This demand is predicted to be especially great in developing countries. The increasing number of automobiles is likely to cause a proportionate increase in pollution. The major challenge facing automobile manufacturers is to reduce undesirable and harmful emissions by improving fuel economy, thereby assuring the increased number of automobiles has a minimal impact on the environment. One method by which automobile manufacturers have attempted to improve fuel economy and reduce undesirable emissions is cylinder deactivation.

Generally, cylinder deactivation is the deactivation of the intake and exhaust valves of a cylinder or cylinders during at least a portion of the combustion process, and is a proven method by which fuel economy can be improved. In effect, cylinder deactivation reduces the number of engine cylinders within which the combustion process is taking place. With fewer cylinders performing combustion, fuel efficiency is increased. For example, in an eight-cylinder engine under certain operating conditions, four of the eight cylinders can be deactivated. Thus, combustion would be taking place in only four, rather than in all eight, cylinders. Cylinder deactivation is effective, for example, during part-load conditions when full engine power is not required for smooth and efficient engine operation. Studies have shown that cylinder deactivation can improve fuel economy by as much as fifteen percent.

Conventional methods of achieving cylinder deactivation, however, have generally been accomplished by the addition of numerous component parts to various portions of the valve train. These additional component parts, such as, for example, multiple springs, arm members, shaft members, and pins, have typically not fit within the space occupied by conventional drive train components. Thus, the conventional methods of implementing cylinder deactivation have required modification and redesign of valve trains and engines to provide the additional space within which to house the additional components used to achieve cylinder deactivation. Furthermore, conventional devices used to achieve cylinder deactivation are typically moderately complex mechanical devices assembled from numerous subassemblies and component parts. The assembly of a device from numerous component parts requires significant labor and the need to inventory and maintain a supply of the various component parts, thereby increasing the cost of manufacture. Moreover, the numerous component parts used in a conventional cylinder deactivation device contribute mass to the device, may impact the reliability of the device, and may limit the performance of the device to certain engine operating parameters.

Therefore, what is needed in the art is a cylinder deactivation device which is designed to fit within existing space occupied by conventional drive train components, thereby avoiding the need to redesign such engines and their valve trains.

Furthermore, what is needed in the art is a cylinder deactivation device that is relatively simple and uses a minimum of component parts, and therefore can be cost-effectively manufactured.

Yet further, what is needed in the art is a cylinder deactivation device having a low mass that is capable of operating over a substantial range of engine operating parameters.

SUMMARY OF THE INVENTION

The present invention provides a deactivation roller finger follower for use with an internal combustion engine.

The invention comprises, in one form thereof, an elongate body having a valve pallet end and a socket. The first end is configured for engaging a valve stem of the internal combustion engine. The socket is configured for engaging a hydraulic lash adjuster of the internal combustion engine. The body defines a roller orifice. A roller is disposed within the roller orifice. The roller is configured for engaging a cam lobe of the internal combustion engine. The roller defines a shaft orifice therethrough. An elongate shaft extends transversely through the shaft orifice. In a default operating position, the shaft is coupled to the body to thereby transfer rotary motion of the cam to pivotal movement of the body about the hydraulic lash adjuster. The shaft is selectively decoupled from the body such that rotary motion of the cam is not transferred to pivotal movement of the body.

An advantage of the present invention is that it occupies the same space within an internal combustion engine as occupied by a conventional roller finger follower.

Another advantage of the present invention is that very few component parts are added relative to a conventional roller finger follower.

Yet another advantage of the present invention is that the device can be easily and cost-effectively manufactured and assembled.

A still further advantage of the present invention is that it is low in mass and high in stiffness, and is therefore capable of operating over a substantial range of engine operating parameters.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE PREFERRED EMBODIMENT

Generally, and as will be described more particularly hereinafter, the deactivation roller finger follower of the present invention has a default state and a decoupled state. In the default state, the deactivation roller finger follower transfers rotary motion of a cam of an internal combustion engine to pivotal movement of the body of the deactivation roller finger follower to thereby actuate a valve stem of the engine which, in turn, opens and closes a corresponding engine valve. The deactivation roller finger follower of the present invention is selectively deactivated from the default state into the decoupled state. In the decoupled state, rotary motion of the cam is not transferred to pivotal motion of the deactivation roller finger follower body. Thus, the valve stem is not actuated and the valve of the engine is not opened or closed, thereby deactivating the corresponding cylinder.

Figure 1:
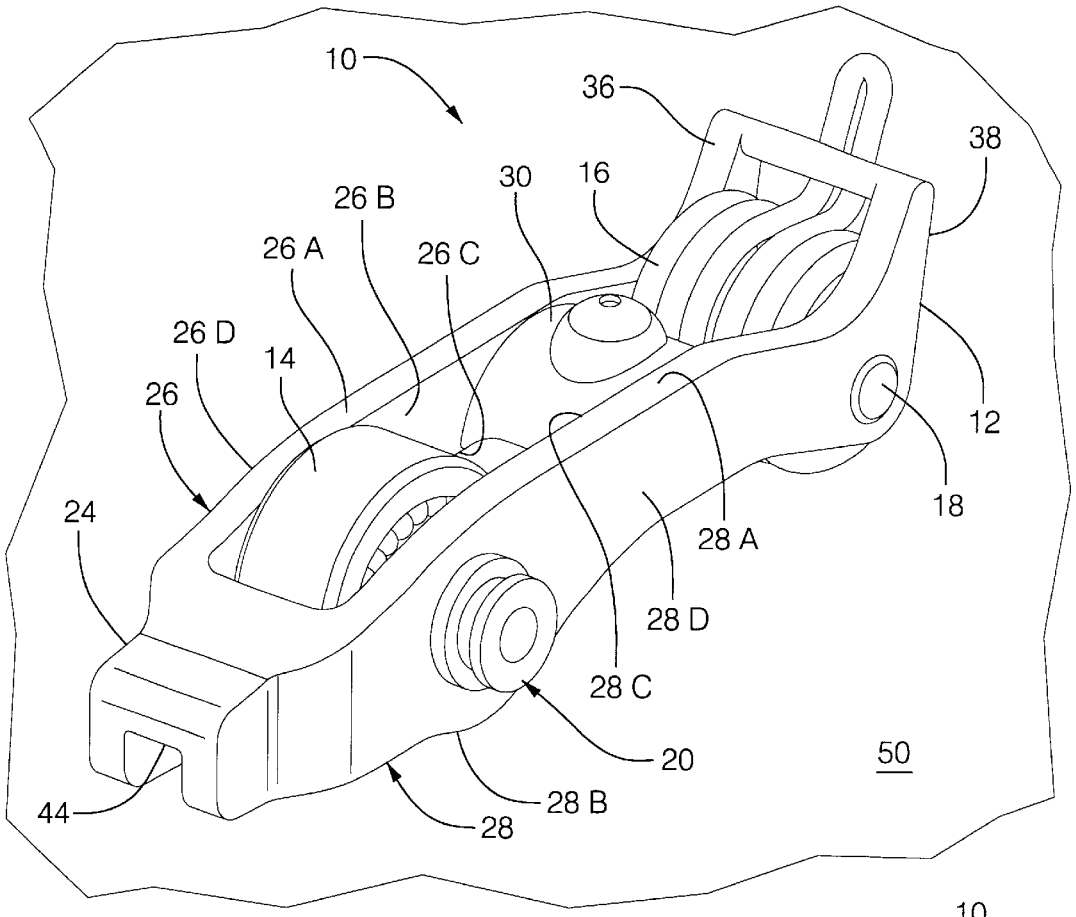
FIG. 1 is a perspective view of one embodiment of the deactivation roller finger follower of the present invention.

Referring now to the drawings and particularly to FIG. 1, there is shown one embodiment of deactivation roller finger follower 10 of the present invention. Deactivation roller finger follower 10 includes body 12, roller 14, lost motion spring 16, arbor 18 and deactivation pin assembly 20.

Figure 5:
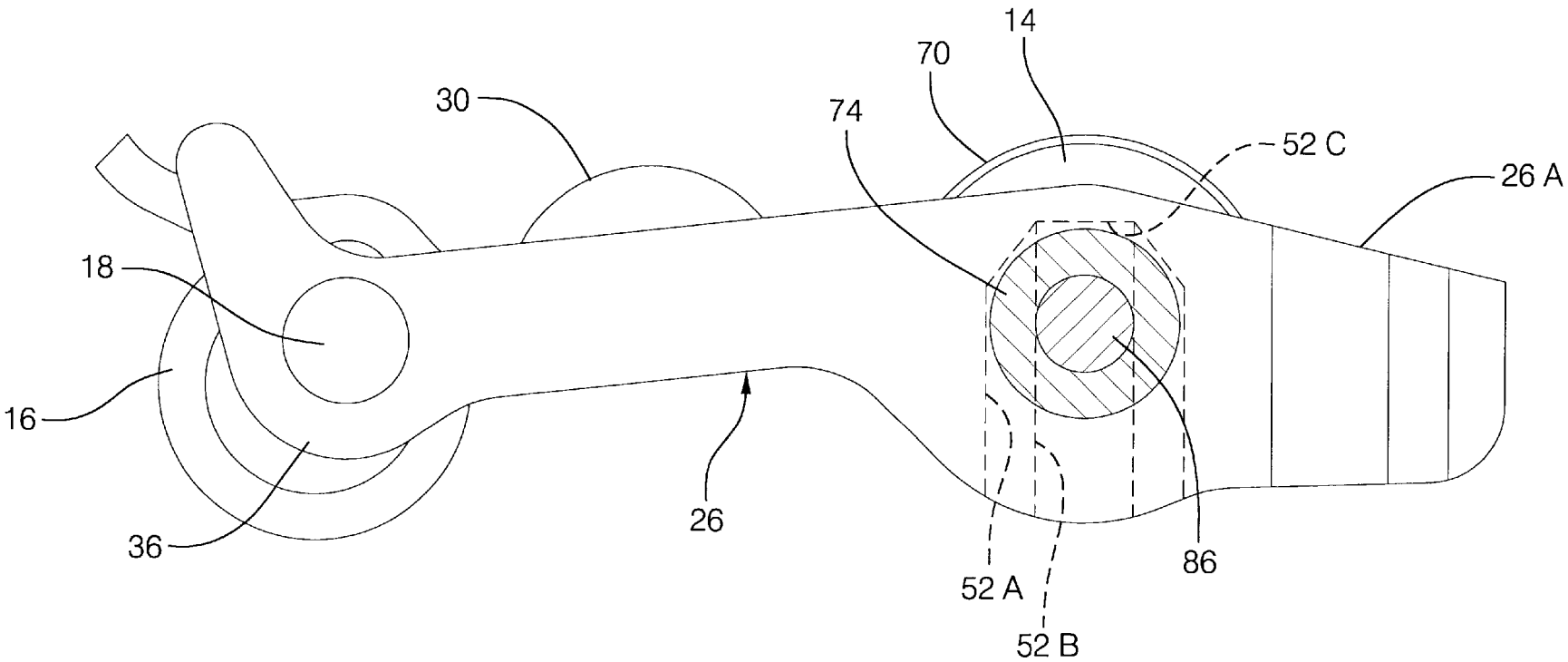
FIG. 5 is a side view of the roller finger follower of FIG. 1.

Body 12 includes end 24, elongate first side member 26, elongate second side member 28, and bridge member 30. Each of first side member 26 and second side member 28 have top surfaces 26*a*, 28*a*, bottom surfaces 26*b*, 28*b*, inside surfaces 26*c*, 28*c*, and outside surfaces 26*d*, 28*d*, respectively. Further, each of first side member 26 and second side member 28 include a respective raised surface or boss 26*e*, 28*e*. Bridge member 30 extends between first side member 26 and second side member 28, and is disposed proximate to top surfaces 26*a* and 28*a*. Bridge member 30 defines semi-spherical lash adjuster socket 32 (FIG. 5), which is configured to receive a stem or ball member (not shown) of a conventional hydraulic lash adjuster (not shown). Body 12 defines roller aperture 34 (FIG. 2) between inside surfaces 26*c* and 28*c* of first and second side members 26, 28, respectively, and intermediate end 24 and bridge member 30. Each of first side member 26 and second side member 28 extend longitudinally in a substantially parallel manner from end 24 and terminate in respective hook-shaped end portions 36, 38. Arbor 18 is carried by and extends transversely between each of end portions 36, 38. End 24 defines valve pallet 44, which is configured to engage the valve stem of a valve of internal combustion engine 50.

Figure 2:
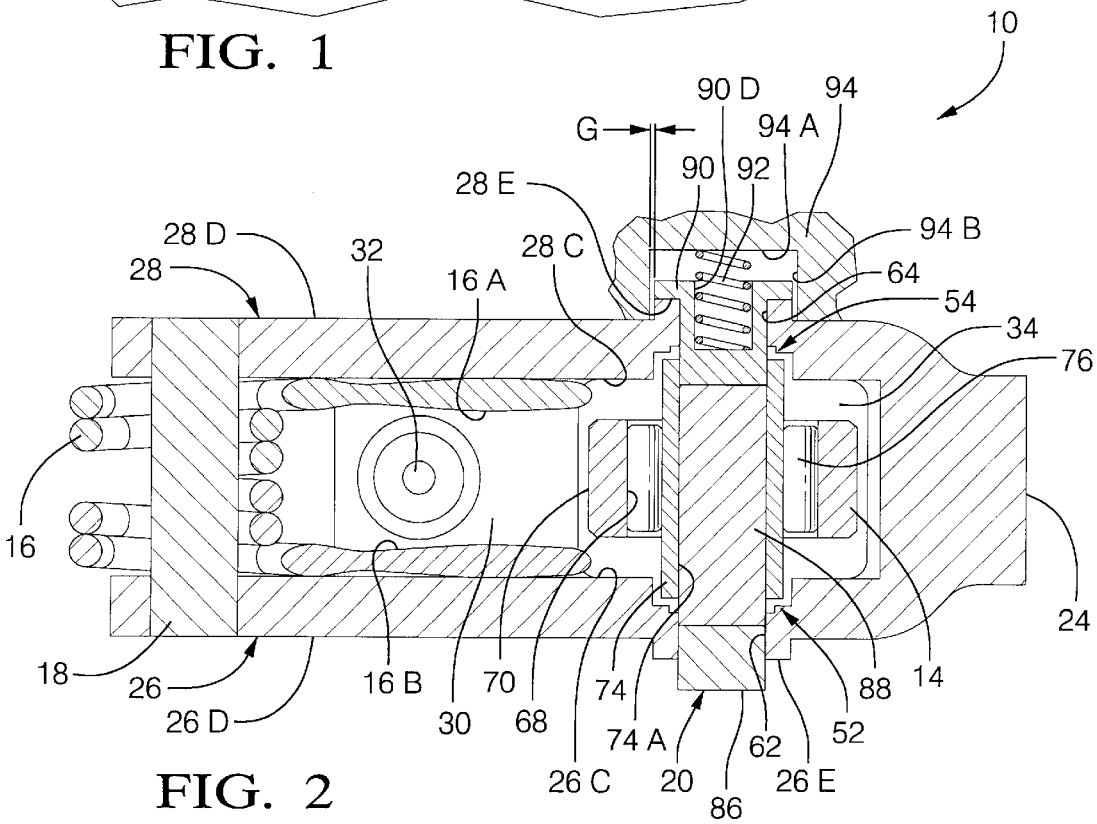
FIG. 2 is a longitudinal cross-sectional plan view of FIG. 1.
Figure 3:
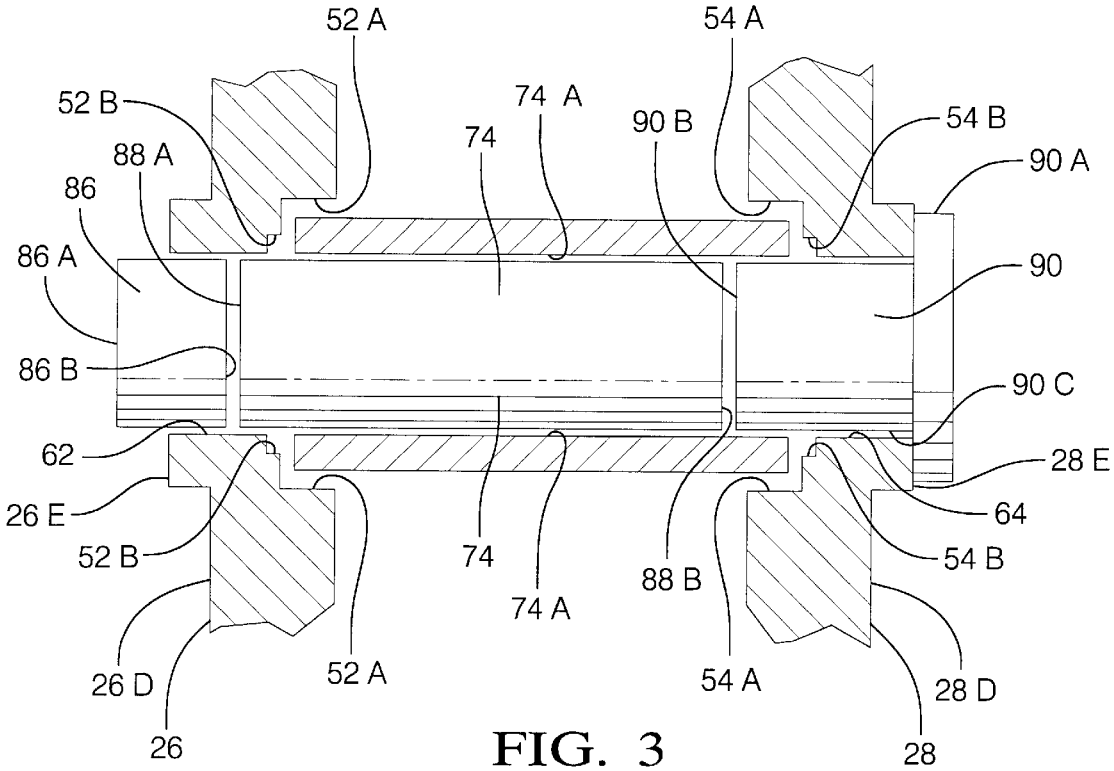
FIG. 3 is a longitudinal cross-sectional view of the deactivation pin assembly of FIG. 1 in the default position.
Figure 4:
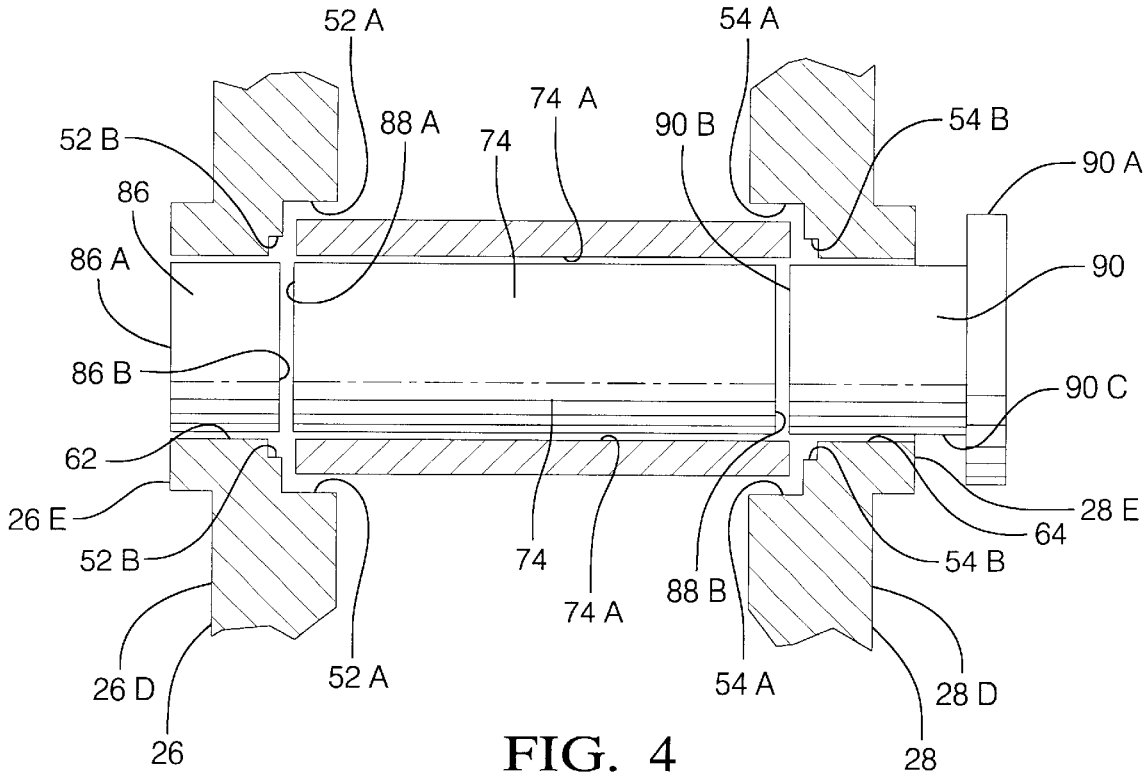
FIG. 4 is a longitudinal cross-sectional view of the deactivation pin assembly of FIG. 1 in the decoupled position.

Referring now to FIGS. 2, 3 and 4, stepped deactivation grooves 52, 54 are defined by inside surfaces 26*c*, 28*c* of first and second side members 26, 28, respectively. Stepped deactivation grooves 52, 54 are disposed intermediate end 24 and bridge member 30, and adjacent to roller aperture 34. As best shown in FIGS. 3 and 4, each of stepped deactivation grooves 52, 54 include a wide portion 52*a*, 54*a*, respectively, and a narrow portion 52*b*, 54*b*, respectively. Wide portions 52*a*, 54*a* are disposed adjacent inside surfaces 26*c*, 28*c* of first and second side members 26, 28, respectively. Narrow portions 52*b*, 54*b* are contained within and longitudinally centered relative to wide portions 52*a*, 54*a*, respectively. Stepped deactivation grooves 52, 54 each include a respective closed end 52*c*, 54*c* (FIG. 5), only one of which is shown, disposed proximate to top surfaces 26*a*, 28*a* of first side member 26 and second side member 28, respectively. Each of closed ends 52*c*, 54*c* have a truncated V-shape. Body 12 defines, within each of stepped deactivation grooves 52, 54, a respective pin orifice 62, 64. Each pin orifice 62, 64 is longitudinally centered within a respective stepped deactivation groove 52, 54 and is spaced a predetermined distance from a respective closed end 52*c*, 54*c*. Body 12 is constructed of, for example, steel, carbon steel, or alloy steel.

Roller 14 is a substantially cylindrical hollow member, and includes inside surface 68 and outside surface 70. Roller 14 is disposed within roller aperture 34 of body 12. Elongate hollow shaft 74 extends through roller 14, having one end disposed in wide portion 52*a* and an opposite end disposed in wide portion 54*a* of stepped deactivation grooves 52, 54, respectively. A plurality of needle bearings 76 are disposed intermediate inside surface 68 of roller 14 and hollow shaft 74. Thus, roller 14 is free to rotate about hollow shaft 74 in an essentially is friction free manner. Roller 14 is configured to engage the cam of internal combustion engine 50. Roller 14 is constructed of, for example, steel, carbon steel, or alloy steel.

Elongate shaft 74 defines a shaft bore 74*a* therethrough. Elongate shaft 74 has a diameter of a predetermined size to enable it to freely reciprocate within wide portions 52*a*, 54*a* in a vertical direction, that is toward and away from closed ends 52*c*, 54*c*, and yet not be received within narrow portions 52*b*, 54*b* of stepped deactivation grooves 52, 54, respectively. Thus, elongate shaft 74 has a diameter that is slightly less than the longitudinal dimension of wide portions 52*a*, 54*a*, and slightly greater than the longitudinal dimension of narrow portions 52*b*, 54*b* of stepped deactivation grooves 52, 54. Shaft 74 is constructed of, for example, steel, carbon steel, or alloy steel.

Lost motion spring 16 is coiled around arbor 18 and includes two leafs 16*a*, 16*b*, each of which extend from arbor 18 proximate to and approximately parallel with a respective one of first and second side members 26, 28. Leafs 16*a*, 16*b* extend under hollow shaft 74 in a concave manner. Lost motion spring 16 applies a load upon hollow shaft 74, thereby biasing hollow shaft 74 toward closed ends 52*c*, 54*c* of stepped deactivation grooves 52, 54, respectively. More particularly, the load applied by lost motion spring 16 biases hollow shaft 74 upward within stepped deactivation grooves 52, 54 and into abutting engagement with truncated V-shaped closed ends 52*c*, 54*c*. The truncated V-shaped closed ends 52*c*, 54*c* positively register shaft bore 74*a* of hollow shaft 74 into alignment with each of pin orifices 62, 64 of first and second side members 26, 28, respectively.

Arbor 18 is a solid pinlike member extending transversely between hook-shaped ends 36, 38, respectively. Lost motion spring 16 is coiled around arbor 18. Arbor 18 acts as a fulcrum for lost motion spring 16 as leafs 16*a,* 16*b* extend concavely under and engage hollow shaft 74. Arbor 18 is constructed of, for example steel, carbon steel, or alloy steel.

As will be described with more particularity hereinafter, deactivation pin assembly 20 in a normal, or default, position couples hollow shaft 74 to body 12. Deactivation pin assembly 20, as best shown in FIGS. 3 and 4, includes cylindrical first outside pin member 86, elongate cylindrical middle pin member 88, cylindrical second outside pin member 90, pin spring 92, and cylindrical hollow button 94. First outside pin member 86 includes outer face 86*a* and inner face 86*b,* and is slidingly disposed within pin orifice 62 of first side member 26. Second outside pin member 90 includes head 90*a,* stem end 90*b,* and shaft portion 90*c*. Second outside pin member 90 defines spring bore 90*d* (FIG. 2) therein. Button 94 is attached, such as, for example, by pressing, to outside surface 28*d* of second side member 28 and closely surrounds head portion 90*a* of second outside pin member 90. A small gap G is formed between side wall 94*b* of button 94 and head portion 90*a* of second outside pin member 90. The gap G permits for the reciprocation of second outside pin 90 member toward and away from inside surface 94*a* of button 94. Pin spring 92 is disposed partially within spring bore 90*d,* and is compressed between inside surface 94*a* of button 94 and second outside pin member 90. Pin spring 92 acts to normally bias deactivation pin assembly 20 into the default, or engaged, position. Each of pin members 86, 88 and 90, and hollow button 94 are constructed of, for example, steel, carbon steel, or alloy steel. Pin spring 92 is constructed of, for example, chrome silicon.

In the default position, as best shown in FIG. 3, first outside pin member 86 extends from within pin orifice 62 such that outer face 86*a* is disposed a predetermined distance from raised surface or boss 26*e* and inner face 86*b* is disposed within pin orifice 62. Shaft portion 90*c* of second outside pin member 90 is essentially disposed entirely within pin orifice 64 in second side member 28 such that head portion 90*a* contacts raised surface or boss 28*e* of second side member 28. Shaft portion 90*c* is of a predetermined length such that when head portion 92 contacts boss 28*e* of second side member 28, stem end 90*b* is disposed within shaft bore 74*a* of hollow shaft 74, thereby coupling shaft 74 to second side member 28. Middle pin member 88 includes first end 88*a* and second end 88*b,* and is slidingly disposed intermediate first outside pin member 86 and second outside pin member 90. In the default or engaged position, middle pin member 88 is disposed partially within shaft bore 74*a* of hollow shaft 74 and partially within pin orifice 62 of first side member 26. More particularly, first end 88*a* is disposed within pin orifice 62 of first side member 26, adjacent to inner face 86*b* of first outside pin member 86, thereby coupling hollow shaft 74 to first side member 26. Second end 88*b* is disposed adjacent stem end 90*b* of second outside pin member 90, within shaft bore 74*a* of hollow shaft 74. Thus, in the default position middle pin member 88 couples hollow shaft 74 to first side member 26 and second outside pin member 90 couples hollow shaft 74 to second side member 28.

Deactivation pin assembly 20 is now described in the decoupled mode with reference being made to FIG. 4. In the decoupled mode, first outside pin member 86 is slidingly displaced within pin orifice 62 in a direction toward inside surface 26*c* of first side member 26. First outside pin member 86 is displaced such that outer face 86*a* is substantially flush with raised surface or boss 26*e,* thereby disposing inner face 86*b* within narrowed portion 52*b* of stepped deactivation groove 52. The displacement of first outside pin member 86 results in a corresponding and simultaneous displacement of middle pin member 88 toward second side member 28. First end 88*a* of middle pin member 88 is thus removed from within pin orifice 62 and into narrowed portion 52*b* of stepped deactivation groove 52, thereby decoupling hollow shaft 74 from first side member 26. The displacement of first outside pin member 86 results in second end 88*b* of middle pin member 88 being simultaneously displaced into and disposed within narrowed portion 54*b* of stepped deactivation groove 54. The displacement of middle pin member 88 results in a corresponding and simultaneous displacement of second outside pin member 90, thereby disposing stem end 90*b* within narrowed portion 54*b* of stepped deactivation groove 54. Stem end 90*b* of second outside pin member 90 is thus removed from within shaft bore 74*a,* thereby decoupling shaft 74 from second side member 28. Thus, shaft 74 is decoupled from each of first and second side members 26, 28.

In use, roller 14 engages a cam lobe (not shown) of the cam (not shown) of internal combustion engine 50. Socket 32 receives a stem, or ball, end (not shown) of a hydraulic lash adjuster (not shown), and valve pallet 44 engages a stem (not shown) of a valve (not shown) of engine 50. In the default or engaged position, shaft 74 is coupled to each of first and second side members 26, 28. As the cam rotates, deactivation roller finger follower 10 pivots about the ball end of the hydraulic lash adjuster, thereby transforming the rotary motion of the cam to vertical movement of valve pallet 44. Vertical movement of pallet 44 is transferred to vertical movement of the valve stem to thereby actuate the corresponding valve of engine 50.

Deactivation roller finger follower 10 is placed into the decoupled state by a control device (not shown), such as, for example, a hydraulic piston which is mounted into a bore on the cam bearing tower adjacent deactivation roller finger follower 10. The piston is aligned with deactivation pin assembly 20. Pressurized fluid, such as, for example, oil, is fed to the bore causing the piston to translate outward and contact first outside pin member 86. The piston continues to translate a predetermined distance outward, thereby forcing outer face 86*a* of first outside pin member 86 to be substantially flush with raised surface or boss 26*e*. The displacement of first outside pin member 86 results in the simultaneous displacement of first end 88*a* of middle pin member 88 into narrow portion 52*b* of stepped deactivation groove 52 and second end 88*b* into narrow portion 54*b* of stepped deactivation groove 54. The displacement of middle pin member 88 results in the simultaneous displacement of stem end 90*b* of second outside pin member 90 from within shaft bore 74*a* and into narrow portion 54*b* of stepped deactivation groove 54. Thus, hollow shaft 74 is decoupled from each of first and second side members 26, 28.

In the decoupled state with the cam lobe at its lowest lift profile position, the force of lost motion spring 16 normally biases hollow shaft 74 into abutting relation with closed ends 52*c,* 54*c* of wide portions 52*a,* 54*a* of stepped deactivation grooves 52, 54, respectively. As the cam lobe is rotated into a higher lift profile, a downward force is exerted onto roller 14 and, in turn, upon hollow shaft 74. The force of lost motion spring 16 upon hollow shaft 74 is overcome by the force exerted through roller 14 upon hollow shaft 74, and hollow shaft 74 is displaced downward within wide portions 52*a,* 54*a* of stepped deactivation grooves 52, 54, respectively, toward bottom surfaces 26*b,* 28*b* of first and second body members 26, 28, respectively. Thus, the motion of the cam is not transferred to body 12 but, rather, results in the downward displacement of shaft 74 within stepped deactivation grooves 52, 54. The motion of shaft 74 is absorbed by the downward displacement of leafs 16*a*, 16*b* of lost motion spring 16. Stepped deactivation grooves 52, 54 retain and guide the movement of shaft 74 during downward displacement thereof. Stepped deactivation grooves 52, 54 are of a predetermined length in order to retain hollow shaft 74 within wide portions 52*a*, 54*a* at maximum cam lobe lift. As the cam lobe is rotated from a higher lift position to a lower lift position, the load exerted upon hollow shaft 74 by lost motion spring 16 maintains roller 14 in contact with the cam lobe and also prevents the hydraulic lash adjuster from pumping up due to internal oil pressure. Stepped deactivation grooves 52, 54 retain and guide the movement of shaft 74 during the return of the cam lobe rotates back to the lower lift position.

In order to return deactivation roller finger follower 10 to the default position, the control device is deactivated thereby removing the force which biased deactivation pin assembly 20 into the decoupled mode. The load applied by lost motion spring 16 upon hollow shaft 74 maintains roller 14 in contact with the cam lobe. As the cam lobe returns to its zero lift profile, lost motion spring 16 biases hollow shaft 74 upward and against closed ends 52*c*, 54*c* of stepped deactivation grooves 52, 54. Closed ends 52*c*, 54*c* act as positive stops for shaft 74 and align shaft bore 74*a* of hollow shaft 74 with each of pin orifices 62, 64. Pin spring 92 biases deactivation pin assembly 20 into the default position. More particularly, when shaft bore 74*a* is aligned with each of pin orifices 62, 64, pin spring 92 displaces stem end 90*b* of second outside deactivation pin 90 into shaft bore 74*a* of hollow shaft 74 and first end 88*a* of middle pin member 88 into pin orifice 62, thereby coupling shaft 74 to body 12. As the cam lobe rotates from zero lift, it exerts a force on roller 14, through shaft 74, which is transferred to pivotal motion of body 12.

It should be particularly noted that the diameter of shaft 74 is a predetermined amount less than the longitudinal dimension, or width, of wide portions 52*a*, 54*a* of stepped deactivation grooves 52, 54. The predetermined difference between the diameter of shaft 74 and wide portions 52*a*, 54*a* permits shaft 74 to freely reciprocate vertically within wide portions 52*a*, 54*a* in the deactivated state. The predetermined difference between the diameter of shaft 74 and wide portions 52*a*, 54*a* is carefully controlled to limit the tendency of shaft 74 to skew relative to wide portions 52*a*, 54*a*. The truncated V-shape of closed ends 52*c*, 54*c* ensure that any skew of shaft 74 relative to stepped deactivation grooves 52, 54 is removed, to thereby center shaft bore 74*a* relative to each of pin orifices 62, 64 and thus ensure proper alignment of shaft bore 74*a* with each of pin orifice 62, 64.

In the embodiment shown, closed ends 52*c*, 54*c* of stepped deactivation grooves 52, 54 are configured as having a truncated V-shape. However, it is to be understood that closed ends 52*c*, 54*c* can be alternately configured, such as, for example, having a U-shape, and still achieve the objects of the present invention.

In the embodiment shown, ends 36, 38 are configured as hook-shaped ends. However, it is to be understood that ends 36, 38 may take virtually any other shape, such as, for example, square, and still achieve the objects of the present invention.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. An internal combustion engine, comprising a deactivation roller finger follower, said deactivation roller finger follower comprising:

a body having a first end configured for engaging a valve stem of the internal combustion engine, a socket disposed on said body and being configured for engaging a hydraulic lash adjuster of the internal combustion engine, said body defining a roller aperture intermediate said first end and said socket, said body defining a first pin orifice and a second pin orifice, said first pin orifice being disposed on a first side of said body adjacent said roller aperture, said second pin orifice being disposed on a second side of said body adjacent said roller aperture, said first pin orifice being transversely opposite from said second pin orifice;

a roller disposed within said roller aperture of said body, said roller defining a roller orifice therethrough;

an elongate shaft disposed within and extending transversely through said roller orifice, said shaft defining a shaft bore therethrough, said shaft having a first end disposed proximate said first pin orifice and a second end disposed proximate said second pin orifice, said shaft bore being normally aligned with each of said first pin orifice and said second pin orifice; and a deactivation pin assembly having at least one elongate pin member, each of said at least one elongate pin member being disposed within at least one of said first pin orifice, said second pin orifice and said shaft bore, said deactivation pin assembly coupling said shaft to said body when said deactivation pin assembly is in a default position to thereby transfer rotary motion of the cam to pivotal movement of said body about the hydraulic lash adjuster, said deactivation pin assembly configured for being selectively removed from said default position into a decoupled position wherein said shaft is decoupled from said body such that the rotary motion of the cam is not transferred to pivotal movement of said body.

2. A deactivation roller finger follower for use with an internal combustion engine, comprising:

an elongate body having a pallet end and a socket, said pallet end configured for engaging a valve stem of the internal combustion engine, said socket configured for engaging a hydraulic lash adjuster of the internal combustion engine, said body defining a roller aperture;

a roller disposed within said roller aperture, said roller being configured for engaging a cam lobe of the internal combustion engine, said roller defining a shaft orifice therethrough;

an elongate shaft extending transversely through said shaft orifice;

coupling means having a default position, said coupling means when in said default position coupling said shaft to said body, said shaft thereby transferring rotary motion of the cam to pivotal movement of said body about the hydraulic lash adjuster, said coupling means configured for being selectively removed from said default position and placed into a decoupled position to thereby decouple said shaft from said body such that the rotary motion of the cam is not transferred to pivotal movement of said body; wherein, said shaft defines a shaft bore therethrough;

said body defines at least one pin orifice, said at least one pin orifice being disposed adjacent said roller aperture; and said coupling means comprises a deactivation pin assembly having at least one pin member, said at least one pin member having a second portion disposed partially within said shaft bore and a first portion disposed within a corresponding one of said at least one pin orifice when said deactivation pin assembly is in said default position.

3. The deactivation roller finger follower of claim 2, wherein said at least one pin orifice comprises a first pin orifice, said first pin orifice being disposed on a first side of said roller aperture, said at least one pin member comprising:

an elongate middle pin member having a first portion and a second portion, said second portion being disposed within said shaft bore and said first portion being disposed within said first pin orifice when said deactivation pin assembly is in said default position, said middle pin member configured for sliding movement within each of said shaft bore and said first pin orifice; and an elongate first outside pin member having a second end disposed within said first pin orifice and a first end disposed a predetermined distance from a first outside surface of said body when said deactivation pin assembly is in said default position, said first outside pin member configured for sliding movement within said first pin orifice, sliding movement of said first outside pin member in a direction towards said shaft resulting in a corresponding sliding movement of said middle pin member thereby displacing said first portion of said middle pin member from within said first pin orifice, thereby placing said deactivation pin assembly into said decoupled position and decoupling said shaft from said body.

4. The deactivation roller finger follower of claim 3, wherein said body defines a second pin orifice, said second pin orifice being disposed on a second side of said roller aperture, said first pin orifice being disposed opposite said second pin orifice, said deactivation pin assembly further comprising:

an elongate second outside pin member having a head portion, a stem portion and a stem end, said head portion disposed in abutting engagement with a second outside surface of said body, said stem portion being disposed within said second pin orifice and said stem end being disposed within said shaft bore when said deactivation pin assembly is in said default position, said second outside pin member being configured for sliding movement within said second pin orifice and within said shaft bore, sliding movement of said first outside pin member in a direction toward said shaft resulting in a corresponding sliding movement of said middle pin member thereby resulting in said stem end of said second outside pin member being displaced from within said shaft bore, thereby placing said deactivation pin assembly into said decoupled position and decoupling said shaft from said body.

5. The deactivation roller finger follower of claim 2, further comprising biasing means normally biasing said deactivation pin assembly into said default position.

6. A deactivation roller finger follower for use in an internal combustion engine, comprising:

a body having a first end configured for engaging a valve stem of the internal combustion engine, a socket disposed on said body and being configured for engaging a lash adjuster of the internal combustion engine, said body defining a roller aperture intermediate said first end and said socket, said body defining a first pin orifice and a second pin orifice, said first pin orifice being disposed on a first side of said body adjacent said roller aperture, said second pin orifice being disposed on a second side of said body adjacent said roller orifice, said first side being transversely opposite from said second side, said first pin orifice being transversely opposite said second pin orifice;

a roller disposed within said roller aperture of said body, said roller defining a roller orifice therethrough;

an elongate shaft disposed within and extending transversely through said roller orifice, said shaft defining a shaft bore therethrough, said shaft having a first end disposed proximate said first pin orifice and a second end disposed proximate said second pin orifice, said shaft bore being normally aligned with each of said first pin orifice and said second pin orifice; and a deactivation pin assembly having at least one elongate pin member, each of said at least one elongate pin member being disposed within at least one of said first pin orifice, said second pin orifice and said shaft bore, said deactivation pin assembly coupling said shaft to said body when said deactivation pin assembly is in a default position to thereby transfer rotary motion of the cam to pivotal movement of said body about the hydraulic lash adjuster, said deactivation pin assembly configured for being selectively removed from said default position into a decoupled position wherein said shaft is decoupled from said body such that the rotary motion of the cam is not transferred to pivotal movement of said body.

7. The deactivation roller finger follower of claim 6, wherein said at least one elongate pin member comprises:

an elongate first outside pin member having a first end and a second end, said second end being disposed within said first pin orifice when said deactivation pin assembly is in said default position, said first outside pin member configured for sliding movement within said first pin orifice in a direction toward and away from said roller aperture;

an elongate middle pin member having a first end and a second end, said first end being disposed within said first pin orifice adjacent said second end of said first outside pin member and said second end of said middle pin member being disposed within said shaft bore when said deactivation pin assembly is in said default position, said middle pin member configured for sliding movement within said shaft bore and within said first pin orifice in a direction toward and away from said second pin orifice in response to a corresponding sliding movement of said first outside pin member, said first end of said inside pin member being displaced from within said first pin orifice by sliding movement of said first pin member toward said second pin orifice thereby removing said deactivation pin assembly from said default position and into said decoupled position.

8. The deactivation roller finger follower of claim 7, wherein said deactivation pin assembly further comprises an elongate second outside pin member disposed within said second pin orifice and within said shaft bore when said deactivation pin assembly is in said default position, said second outside pin member configured for sliding movement within each of said shaft bore and said second pin orifice in a direction toward and away from said first pin orifice in response to a corresponding sliding movement of said first outside pin member, movement of said first outside pin member toward said second pin orifice displacing said first end of said middle pin member from within said first pin orifice and displacing said second outside pin member from within said shaft bore, thereby removing said deactivation pin assembly from said default position and into said decoupled position.

9. The deactivation roller finger follower of claim 8, wherein said second outside pin member comprises:

a head portion normally disposed in abutting engagement with a second outside surface of said body;

a stem portion normally disposed within said second pin orifice; and a stem end normally disposed within said shaft bore adjacent said second end of said middle pin member.

10. The deactivation roller finger follower of claim 9, further comprising:

a button having a top inside surface and an inner wall surface, said button affixed to said second outside surface of said body and surrounding said head portion of said second outside pin member, a gap being defined between said inner wall surface of said button and said head portion of said second outside pin member; and a spring having a first end and a second end, said first end being disposed adjacent said top inside surface of said button, said second end being disposed adjacent said head portion of said second outside pin member, said spring being compressed between said top inside surface of said button and said head portion of said second outside pin member, said spring configured for normally biasing said deactivation pin assembly into said default position.

11. The deactivation roller finger follower of claim 10, wherein said second outside pin member defines a spring bore having an open end and a closed end, said open end being disposed on said head portion, said second end of said spring being disposed adjacent said closed end of said spring bore.

12. The deactivation roller finger follower of claim 8, wherein said body defines a first stepped deactivation groove disposed on said first side of said body adjacent said roller aperture, said second stepped deactivation groove being disposed on said second side of said body adjacent said roller aperture, said first stepped deactivation groove being transversely opposite said second stepped deactivation groove, said first pin orifice and said second pin orifice being substantially longitudinally centered within a respective one of said first stepped deactivation groove and said second deactivation groove, each of said first and said second stepped deactivation groove having a respective wide portion and a respective narrow portion, said first end of said shaft being disposed within said wide portion of said first stepped deactivation groove, said second end of said shaft being disposed within said wide portion of said second stepped deactivation groove.

13. The deactivation roller finger follower of claim 12, wherein each of said first and said second stepped deactivation groove include a respective closed end, each said closed end being disposed a predetermined distance from a respective one of said first and said second pin orifice, each said closed end configured for abuttingly engaging an outside surface of said shaft, said shaft bore being aligned with each of said first pin orifice and said second pin orifice when said outside surface of said shaft is in abutting engagement with each said closed end.

14. The deactivation roller finger follower of claim 13, wherein each said closed end has a truncated V-shape.

15. The deactivation roller finger follower of claim 13, wherein said body includes a second end, a lost motion spring associated with said second end and extending longitudinally toward said first end, said lost motion spring configured for normally biasing said outside surface of said shaft into abutting engagement with each respective said closed end of said first and said second stepped deactivation groove, thereby aligning said shaft bore with each of said first pin orifice and said second pin orifice.

16. The deactivation roller finger follower of claim 13, wherein said deactivation pin assembly is disposed in said decoupled position when said second end of said first outside pin member is disposed within said narrow portion of said first stepped deactivation groove, said first end of said middle pin member is disposed within said narrow portion of said first stepped deactivation groove, said second end of said middle pin member is disposed within said narrow portion of said second stepped deactivation groove, and said stem end of said second outside pin member is disposed within said narrow portion of said second stepped deactivation groove.

17. The deactivation roller finger follower of claim 9, wherein said middle pin member has a pin length, said shaft having a shaft length, said pin length being a predetermined amount greater than said shaft length.

18. The deactivation roller finger follower of claim 6, wherein said body includes a second end, a lost motion spring associated with said second end and extending longitudinally toward said first end, said lost motion spring configured for normally biasing said shaft bore into alignment with each of said first pin orifice and said second pin orifice.

19. The deactivation roller finger follower of claim 7, wherein said body further includes a first stop member disposed a predetermined distance from said first pin orifice, a second stop member disposed a predetermined distance from said second pin orifice, said lost motion spring normally biasing said shaft into abutting engagement with each of said first stop member and said second stop member to thereby dispose said shaft bore in alignment with each of said first pin orifice and said second pin orifice.

* * * * *